US009764578B2

(12) United States Patent
Ehara et al.

(10) Patent No.: US 9,764,578 B2
(45) Date of Patent: Sep. 19, 2017

(54) INK RIBBON, INK RIBBON CASSETTE AND PRINTER

(71) Applicant: MAX CO., LTD., Chuo-ku, Tokyo (JP)

(72) Inventors: Takayuki Ehara, Tokyo (JP); Hiroaki Sudo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 15/258,203

(22) Filed: Sep. 7, 2016

(65) Prior Publication Data

US 2017/0066269 A1 Mar. 9, 2017

(30) Foreign Application Priority Data

Sep. 8, 2015 (JP) ..... 2015-177018

(51) Int. Cl.

| | |
|---|---|
| ***B41J 17/32*** | (2006.01) |
| ***B41J 32/00*** | (2006.01) |
| ***B41J 2/325*** | (2006.01) |
| ***B41J 17/36*** | (2006.01) |
| ***B41J 33/00*** | (2006.01) |

(52) U.S. Cl.

CPC ..... *B41J 32/00* (2013.01); *B41J 2/325* (2013.01); *B41J 17/32* (2013.01); *B41J 17/36* (2013.01); *B41J 33/003* (2013.01)

(58) Field of Classification Search

CPC ..... B65H 75/185; B41J 33/003; B41J 31/10; B41J 32/00; B41J 27/24

See application file for complete search history.

(56) References Cited

U.S. PATENT DOCUMENTS

| | | | | |
|---|---|---|---|---|
| 5,719,616 A * | 2/1998 | Danjo | ..... | B41J 17/36 347/193 |
| 2006/0133879 A1 | 6/2006 | Mindler | | |
| 2009/0123207 A1 | 5/2009 | Mindler | | |

FOREIGN PATENT DOCUMENTS

| | | | | |
|---|---|---|---|---|
| JP | 11-321002 | * 11/1999 | ..... | B41J 17/24 |
| JP | 2005-199582 | * 7/2005 | ..... | B41J 31/00 |
| JP | 2008-525232 A | 7/2008 | | |
| JP | 4334890 B2 | 9/2009 | | |
| JP | 4412913 B2 | 2/2010 | | |
| JP | 5187513 B2 | 4/2013 | | |

OTHER PUBLICATIONS

Computer generated translation of JP 11-321002, published on Nov. 1999.*

Computer generated translation of JP 2005-199582, published on Jul. 2005.*

* cited by examiner

*Primary Examiner* — Huan Tran

(74) *Attorney, Agent, or Firm* — Drinker Biddle & Reath LLP

(57) ABSTRACT

An ink ribbon includes a core and a mounting section. The core is configured to be wound with an ink ribbon tape. The mounting section is mounted with an identification information recording part in which identification information of the ink ribbon tape is recorded to be inputtable and outputtable. The mounting section includes at least one hole section which supports at least one end portion of the core to be rotatable. The mounting section covers at least a part of the core via the ink ribbon tape wound around the core in a state where the core is rotatable.

8 Claims, 15 Drawing Sheets

INK RIBBON, INK RIBBON CASSETTE AND PRINTER

CROSS-REFERENCE TO RELATED APPLICATION

This application is based on and claims priority under 35 USC119 from Japanese Patent Application No. P2015-177018 filed on Sep. 8, 2015.

TECHNICAL FIELD

The present invention relates to an ink ribbon including an identification information recording part, an ink ribbon cassette stored with the ink ribbon, and a printer from which the ink ribbon cassette is detachable.

BACKGROUND

In the related art, there has been proposed an ink ribbon provided with an identification information recording part recorded with identification information. In a configuration in which an ink ribbon is exchangeable for a printer, there has been proposed a technology provided with an identification information recording part on a circumferential surface of a cylindrical winding core wound with an ink ribbon tape (for example, see JP-B-5187513).

Furthermore, there has been proposed a technology in which an adapter provided with an identification information recording part is attached to the axis of a winding core (for example, see JP-A-2008-525232). Moreover, there has been proposed a technology in which a mounting part of an identification information recording part is provided to an end portion of the axis of a winding core (for example, see JP-B-4412913). Furthermore, there has been proposed a technology in which an identification information recording part is provided to a connection member wound around a winding core (for example, see JP-B-4334890).

SUMMARY

In the configuration in which the identification information recording part is provided to the circumferential surface of a rotating member, such as a winding core, of an ink ribbon tape, a distance between an antenna wirelessly communicating with the identification information recording part and the identification information recording part is changed by the rotation of the winding core due to the conveyance of the ink ribbon tape. Therefore, the identification information recording part may not face the antenna according to an angle at which the winding core stops, and communication for input/output of information may not be performed.

The ink ribbon tape is wound on the identification information recording part, so that pressure is applied to the identification information recording part by the ink ribbon tape, resulting in the probability that the identification information recording part will be damaged. Moreover, when the diameter of the winding core is reduced, the length of the ink ribbon tape, which can be wound around the winding core, can increase, but since the identification information recording part is curved and a load is applied, it is probable that the identification information recording part will be damaged.

In the configuration in which the identification information recording part is configured to be mounted on the axis of the winding core, since the position of the identification information recording part is changed by the rotation of the axis, it is probable that communication will not be performed. Furthermore, since the length of the axis increases, it is difficult to reduce the size of a printer, in which the winding core is mounted.

In the configuration in which the identification information recording part is provided to the connection member, since the connection member rotates together with the winding core, the position of the identification information recording part is changed by the rotation of the connection member, so that it is probable that communication will not be performed. Furthermore, when the ink ribbon is exchanged, it is also necessary to exchange the connection member, resulting in an increase in the cost of consumables.

The present invention has been made to solve the above-described problem, and an object of the present invention is to provide an ink ribbon, which includes an identification information recording part recorded with identification information and the like of an ink ribbon tape in the state in which information input/output is always possible and can suppress cost, an ink ribbon cassette stored with the ink ribbon, and a printer from which the ink ribbon cassette is detachable.

An ink ribbon according to the present invention includes a core and a mounting section. The core is configured to be wound with an ink ribbon tape. The mounting section is mounted with an identification information recording part in which identification information of the ink ribbon tape is recorded to be inputtable and outputtable. The mounting section includes at least one hole section which supports at least one end portion of the core to be rotatable. The mounting section covers at least a part of the core via the ink ribbon tape wound around the core in a state where the core is rotatable.

An ink ribbon cassette according to the present invention includes an ink ribbon, a body case. The ink ribbon includes a core and a mounting section. The core is configured to be wound with an ink ribbon tape. The mounting section is mounted with an identification information recording part in which identification information of the ink ribbon tape is recorded to be inputtable and outputtable. The mounting section includes at least one hole section which supports at least one end portion of the core to be rotatable. The mounting section covers at least a part of the core via the ink ribbon tape wound around the core in a state where the core is rotatable. The ink ribbon is stored in the body case to be detachable. The body case includes a storage section. The storage section has a receiving part supporting a connection member to be rotatable and stores the mounting section such that the mounting section covers at least a part of the core to be stored to be detachable. The connection member is mounted in the core to be detachable.

A printer according to the present invention includes an ink ribbon, an ink ribbon cassette, a cassette mounting unit, a print unit, a conveying roller (a conveying unit) and a communication unit. The ink ribbon includes a core and a mounting section. The core is configured to be wound with an ink ribbon tape. The mounting section is mounted with an identification information recording part in which identification information of the ink ribbon tape is recorded to be inputtable and outputtable. The mounting section includes at least one hole section which supports at least one end portion of the core to be rotatable. The mounting section covers at least a part of the core via the ink ribbon tape wound around the core in a state where the core is rotatable. The ink ribbon is stored in the ink ribbon cassette to be detachable. The ink ribbon cassette is detached from the cassette mounting unit. The print unit performs printing on a print medium with the ink ribbon tape. The conveying roller (the conveying unit) conveys the print medium. The communication unit performs input and output of identification information with respect to the identification information recording part. The ink ribbon cassette includes a body case that has a storage section which has a receiving part supporting a connection member and which stores the mounting section such that the mounting section covers at least a part of the core to be detachable. The connection member is mounted in the core to be detachable.

The ink ribbon of the present invention includes a mounting section configured to cover a part of a core wound with an ink ribbon tape, and is provided in the configuration in which an identification information recording part has been mounted in the mounting section. In the ink ribbon, the mounting section mounted with the identification information recording part is provided together with the core wound with the ink ribbon tape. In this way, it is possible to provide the ink ribbon having the identification information recording part at low cost. Furthermore, a worker who exchanges the ink ribbon can exchange the ink ribbon without recognizing the identification information recording part.

In the ink ribbon cassette of the present invention, the ink ribbon having the identification information recording part is detachable, so that it is possible to repetitively use a body case and a connection member and to operate them at low cost. Furthermore, even when the diameter of the core is reduced in order to increase the length of the ink ribbon tape, the identification information recording part is not curved and it is possible to prevent damage.

In the printer of the present invention, since the ink ribbon is stored and mounted in the ink ribbon cassette, attachment and detachment can be easily performed. Furthermore, in the printer of the present invention, when the ink ribbon cassette is mounted, communication for input/output of information with the identification information recording part of the ink ribbon cassette becomes possible. Since the identification information recording part is mounted in the mounting section in the state in which the rotation of the core by the conveyance of the ink ribbon tape is possible, the position of the identification information recording part is not changed by the conveyance of the ink ribbon tape.

In this way, input/output of information with the identification information recording part is always possible, so that input/output of identification information is possible with respect to the identification information recording part at an arbitrary timing.

DETAILED DESCRIPTION

Hereinafter, an ink ribbon, an ink ribbon cassette, and a printer according to an embodiment of the present invention will be described with reference to each of drawings.

<Configuration Example of Ink Ribbon of Present Embodiment>

Figure 1:
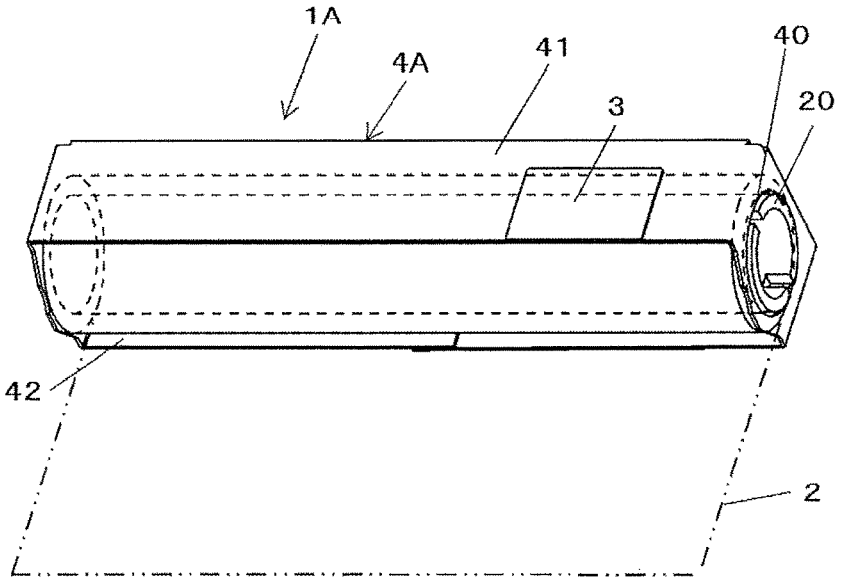
FIG. 1 is a configuration diagram illustrating an example of an ink ribbon according to an embodiment of the invention.
Figure 2:
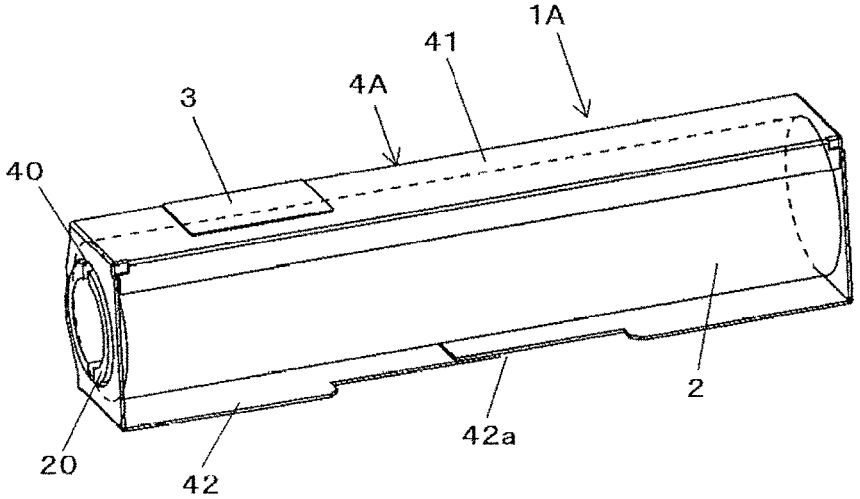
FIG. 2 is a configuration diagram illustrating an example of the ink ribbon according to the embodiment of the invention.
Figure 3:
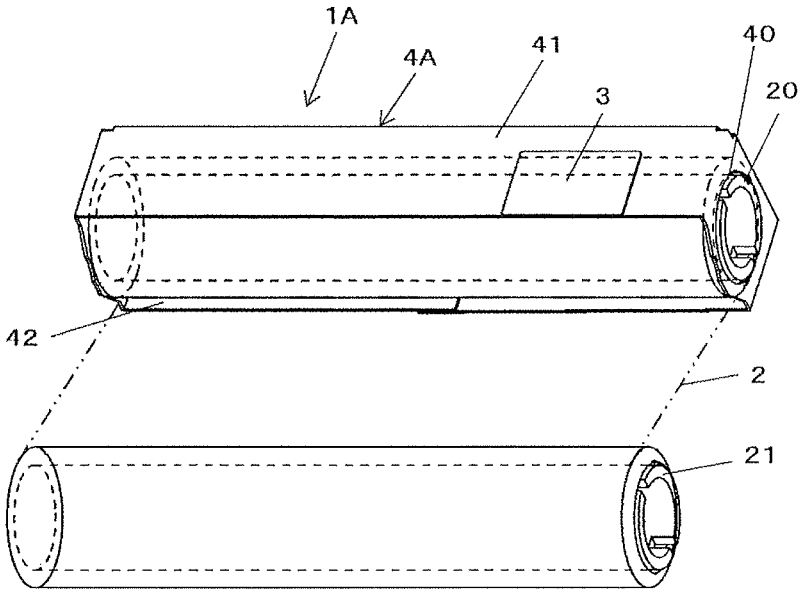
FIG. 3 is a configuration diagram illustrating an example of the ink ribbon according to the embodiment of the invention.

FIGS. 1 to 3 are configuration diagrams illustrating an example of an ink ribbon of the present embodiment.

An ink ribbon 1A of the present embodiment includes a feeding core 20 around which an ink ribbon tape 2 is wound, a winding core 21 around which the ink ribbon tape 2 is wound, and a mounting section 4A in which an MID tag 3 is mounted.

In the present example, the ink ribbon tape 2 is configured by coating ink, which can be transferred to a print object by heat and pressure, on a long medium in a thin film state.

The feeding core 20 is an example of a core, and the ink ribbon tape 2 before being used is wound at the time of the start of new use. The feeding core 20 is configured with a cylindrical member such as a paper and resin. The winding core 21 is an example of a core, and the ink ribbon tape 2 after being used is wound. The winding core 21 is configured with a cylindrical member such as a paper and resin. In the present example, the ink ribbon tape 2 is provided in the state in which one end of a long shape has been wound around the feeding core 20 and the other end can be wound, for example, adheres to the winding core 21.

The RFID tag 3 is an example of an identification information recording part, and is configured such that reading of recorded information by wireless communication and recording of information by wireless communication are possible. In the present example, color information of ink printable on the ink ribbon tape 2, type information regarding the type of ink printable on the ink ribbon tape 2, consumption amount information of the ink ribbon tape 2, manufacturer information and the like are recorded on the RFID tag 3 as identification information. In the RFID tag 3, a predetermined circuit (not illustrated) enabling information recording, information input/output and the like is formed on a sheet such as a paper and resin, and an adhesive layer coated on the rear surface thereof with an adhesive is formed.

The mounting section 4A is configured to cover a predetermined place, other than a conveyance path of the ink ribbon tape 2 fed from the feeding core 20, and in the present example, the mounting section 4A is configured to cover both ends in an axial direction of the feeding core 20 and two surfaces facing a width direction along the axial direction of the feeding core 20 via the ink ribbon tape 2 wound around the feeding core 20.

The mounting section 4A is formed with holes 40 passing through one end surface and the other end surface in the axial direction of the feeding core 20. Furthermore, a tag mounting surface 41 is configured on one surface facing the width direction of the ink ribbon tape 2 along the axial direction of the feeding core 20, and a positioning surface 42 for a mounting object is configured on the other surface. The tag mounting surface 41, which is one surface of the mounting section 4A, covers at least a part of the feeding core 20 via the ink ribbon tape 2 wound around the feeding core 20.

In the present example, in the mounting section 4A, each surface is configured with a plane and an external appearance is an approximately rectangular parallelepiped shape. Furthermore, the mounting section 4A is configured with a paper or a resin material, but is configured with transparent resin, so that the feeding core 20 wound with the ink ribbon tape 2 is visible as compared with an outer side of the mounting section 4A in the configuration in which the mounting section 4A covers the feeding core 20 via the ink ribbon tape 2 wound around the feeding core 20.

The mounting section 4A is configured such that its longitudinal length is slightly shorter than the length in the axial direction of the feeding core 20 and the diameter of the hole 40 is slightly larger than that of the feeding core 20. Furthermore, the feeding core 20 is configured such that its axial length is longer than the width of the ink ribbon tape 2. In this way, when the feeding core 20 is configured to be covered with the mounting section 4A, both ends of the feeding core 20 respectively enter into the holes 40 and are supported by the mounting section 4A in the state where the feeding core 20 is rotatable. As described above, a supporting part, which supports at least one end portion of the feeding core 20 to be rotatable, is configured with the holes 40 of the mounting section 4A and the feeding core 20.

In the present example, in the mounting section 4A, the RFID tag 3 is adhered to the tag mounting surface 41 by an adhesive (not illustrated). The RFID tag 3 is adhered to a position which is closer to one end side than the other end side in the longitudinal direction of the tag mounting surface 41. In the mounting section 4A, a concave part 42*a* serving as a positioning part is formed at one side portion of the positioning surface 42.

As illustrated in FIGS. 1 and 2, the ink ribbon 1A may be configured to be provided by combining the feeding core 20 wound with the ink ribbon tape 2 with the mounting section 4A mounted with the RFID tag 3, or, as illustrated in FIG. 3, may be configured to be provided by combining the feeding core 20 and the mounting section 4A with the winding core 21.

<Operation Effect Example of Ink Ribbon of Present Embodiment>

The ink ribbon 1A of the present embodiment includes the mounting section 4A configured to cover at least a part of the feeding core 20, around which the ink ribbon tape 2 is wound, via the ink ribbon tape 2, and is provided in the configuration in which the RFID tag 3 has been mounted on the mounting section 4A.

In the ink ribbon 1A, the mounting section 4A mounted with the RFID tag 3 is provided together with the feeding core 20 wound with the ink ribbon tape 2. In this way, parts required for exchanging the ink ribbon 1A are reduced, so that it is possible to provide the ink ribbon 1A having the RFID tag 3 at low cost.

In the ink ribbon 1A of the present embodiment, since the RFID tag 3 is mounted on the mounting section 4A which is a separate component from the feeding core 20, the tag mounting surface 41, which is a mounting place of the RFID tag 3, can be made into a plane, or an arbitrary curved surface to which no load is applied to the RFID tag 3, so that it is possible to suppress damage of the RFID tag 3.

In the ink ribbon 1A of the present embodiment, when the feeding core 20 is configured to be covered with the mounting section 4A, since both ends of the feeding core 20 respectively enter into the holes 40 of the mounting section 4A, the mounting section 4A and the feeding core 20 are difficult to be separated from each other, so that it is possible to prevent the treatment of the mounting section 4A and the feeding core 20 from being complicated.

In addition, the mounting section 4A can be provided with a seal including instructions for use and the like of a mounting method and the like of the ink ribbon 1A by adhesion for example, so that it is possible to reliably perform a detachment operation and the like without a separate manual. Furthermore, the mounting section 4A can also be provided with a seal including a color, a type, a name and the like of the ink ribbon 1A, and in this case, it is possible to visually confirm that it is an ink ribbon suiting a purpose. Moreover, in the case in which the RFID tag 3 is adhered to a position of the mounting section 4A which is closer to one end portion than the other end portion, when the ink ribbon 12A has been mounted with respect to an ink ribbon cassette 10A to be described later in the state in which the direction of the ink ribbon 1A has been erroneously set, since a distance between the RFID tag 3 and an antenna 115 to be described later is increased, communication between the RFID tag 3 and the antenna 115 is not possible, so that information acquirement is not possible. In this way, it is possible to limit a print operation when the ink ribbon 1A has been erroneously mounted with respect to the ink ribbon cassette 10A.

<Configuration Example of Ink Ribbon Cassette of Present Embodiment>

Figure 4:
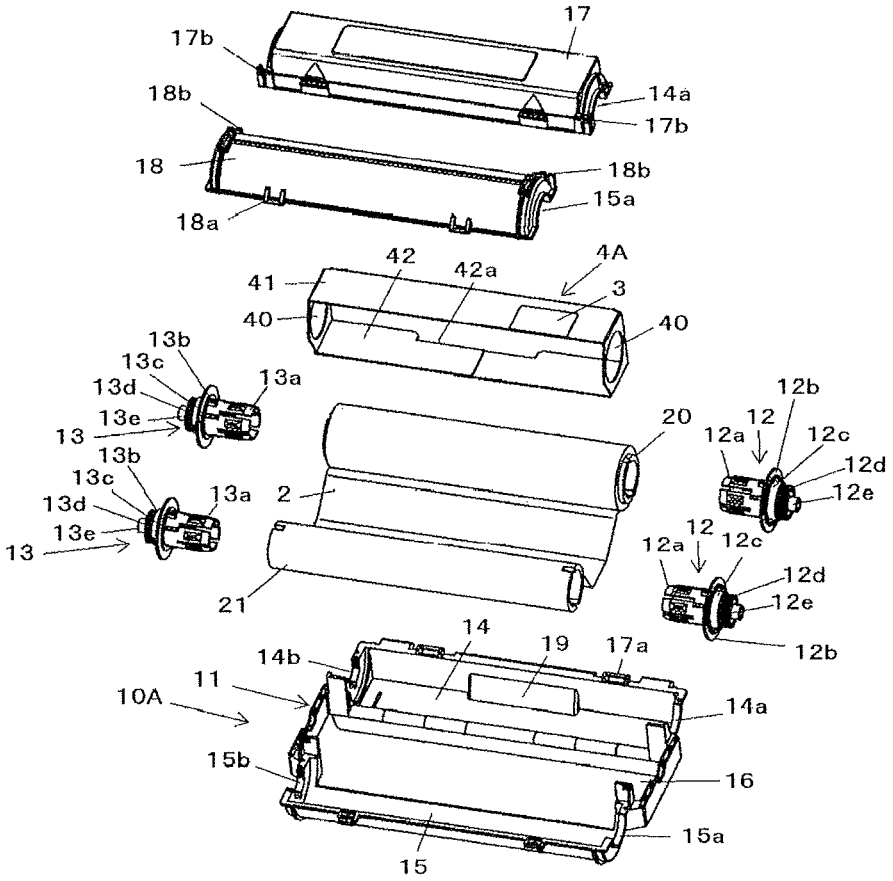
FIG. 4 is a configuration diagram illustrating an example of an ink ribbon cassette according to the embodiment of the invention.
Figure 5:
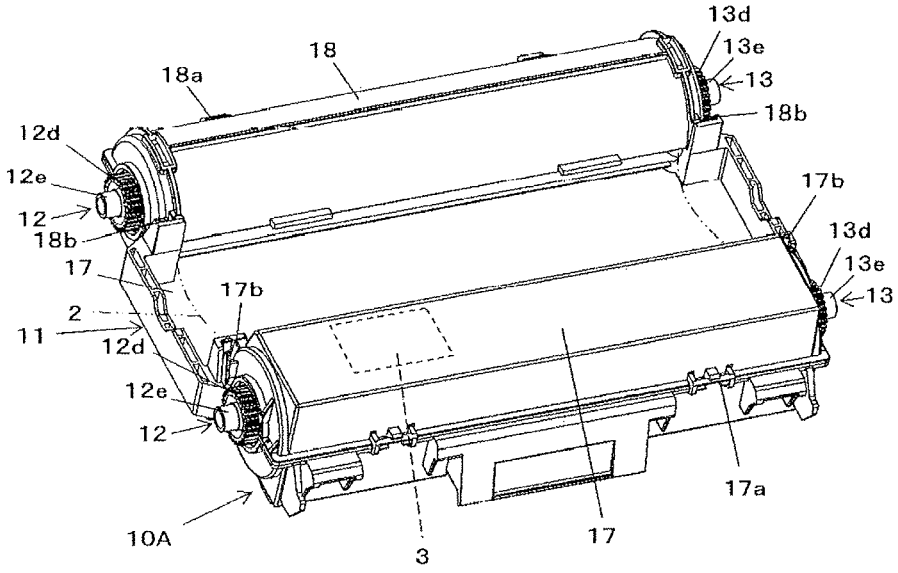
FIG. 5 is a configuration diagram illustrating an example of the ink ribbon cassette according to the embodiment of the invention.
Figure 6:
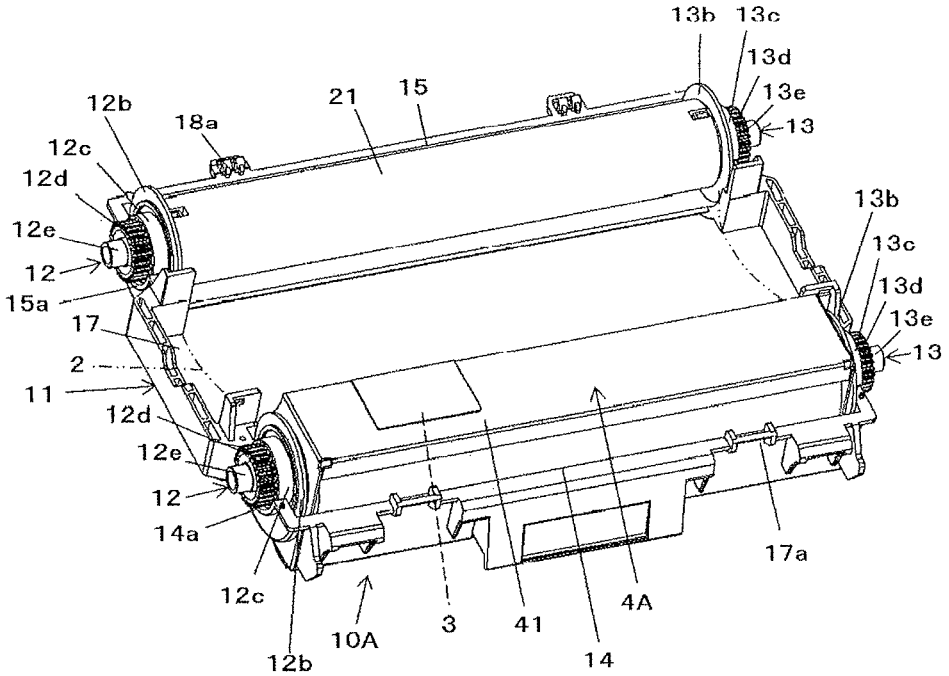
FIG. 6 is a configuration diagram illustrating an example of the ink ribbon cassette according to the embodiment of the invention.

FIGS. 4 to 6 are configuration diagrams illustrating an example of an ink ribbon cassette of the present embodiment. FIG. 4 is an exploded perspective view of the ink ribbon cassette of the present embodiment, FIG. 5 is an external appearance perspective view of the ink ribbon cassette of the present embodiment, and FIG. 6 is an external appearance perspective view when each cover of the ink ribbon cassette of the present embodiment has been removed.

The ink ribbon cassette 10A of the present embodiment includes a body case 11 in which the ink ribbon 1A illustrated in FIG. 1 and the like is detachably stored. The ink ribbon cassette 10A includes first connection members 12 respectively mounted in one end portion of the feeding core 20 and one end portion of the winding core 21, and second connection members 13 respectively mounted in the other end portion of the feeding core 20 and the other end portion of the winding core 21.

The body case 11 includes a first storage section 14 in which the feeding core 20 wound with the ink ribbon tape 2 and the mounting section 4A are stored, and a second storage section 15 in which the winding core 21 wound with the ink ribbon tape 2 is stored.

Furthermore, the body case 11 includes a tape conveying part 16 between the first storage section 14 and the second storage section 15, which exposes the ink ribbon tape 2 fed from the feeding core 20 stored in the first storage section 14 and wound around the winding core 21 stored in the second storage section 15.

Moreover, the body case 11 includes a first cover 17 that opens and closes the first storage section 14 and a second cover 18 that opens and closes the second storage section 15.

In the body case 11, a concave part matching with the shape of the mounting section 4A and having an approximately rectangular parallelepiped shape in the present example is provided at an upstream side with respect to a conveyance direction of the ink ribbon tape 2, so that the first storage section 14 is configured. In the body case 11, a positioning convex part 19, around which the concave part 42*a* of the mounting section 4A is fitted, is formed at a bottom portion of the first storage section 14, wherein the mounting section 4A is stored the first storage section 14 together with the feeding core 20 in a predetermined direction. The positioning convex part 19 is an example of a part to be positioned, and is provided at one side portion in a longitudinal direction along the axial direction of the feeding core 20 stored in the first storage section 14 in the present example.

Furthermore, in the body case 11, a first receiving part 14*a* is formed at one end portion in the width direction of the first storage section 14 while facing one end portion in the axial direction of the feeding core 20 stored in the first storage section 14, and supports the first connection member 12 mounted in the feeding core 20. Moreover, in the body case 11, a second receiving part 14*b* is formed at the other end portion in the width direction of the first storage section 14 while facing the other end portion in the axial direction of the feeding core 20 stored in the first storage section 14, and supports the second connection member 13 mounted in the feeding core 20.

In the body case 11, a concave part matching with the shape of the winding core 21 wound with the ink ribbon tape 2 and having an approximately columnar shape in the present example is provided at a downstream side with respect to the conveyance direction of the ink ribbon tape 2, so that the second storage section 15 is configured.

In the body case 11, a first receiving part 15*a* is formed at one end portion in the width direction of the second storage section 15 while facing one end portion in the axial direction of the winding core 21 stored in the second storage section 15, and supports the first connection member 12 mounted in the winding core 21. Moreover, in the body case 11, a second receiving part 15*b* is formed at the other end portion in the width direction of the second storage section 15 while facing the other end portion in the axial direction of the winding core 21 stored in the second storage section 15, and supports the second connection member 13 mounted in the winding core 21.

The first connection member 12 includes a core mounting part 12*a* inserted into one end portion in the axial direction of the feeding core 20, a flange part 12*b* that defines a mounting position in the axial direction of the feeding core 20, a shaft support part 12*c* supported by the first receiving part 14*a* of the body case 11, a gear 12*d* to which driving force is transferred, and a shaft part 12*e* supported by a printer to be described later. In addition, the first connection member 12 mounted at one end portion in the axial direction of the winding core 21 also has a similar configuration.

The second connection member 13 includes a core mounting part 13*a* inserted into the other end portion in the axial direction of the feeding core 20, a flange part 13*b* that defines the mounting position in the axial direction of the feeding core 20, a shaft support part 13*c* supported by the second receiving part 14*b* of the body case 11, a gear 13*d* to which driving force is transferred, and a shaft part 13*e* supported by the printer to be described later. In addition, the second connection member 13 mounted at the other end portion in the axial direction of the winding core 21 also has a similar configuration.

In the present example, the first cover 17 is mounted in the body case 11 to be able to open and close the first storage section 14 through rotation in which a support point part 17*a* serves as a support point. FIGS. 4 and 6 illustrate that the first cover 17 has been detached from the body case 11; however, the first cover 17 can be opened and closed even without detaching the support point part 17*a*. In the first cover 17, a lock part 17*b* is locked with the body case 11, so that the first storage section 14 is held in a closed state.

In the present example, the second cover 18 is mounted in the body case 11 to be able to open and close the second storage section 15 through rotation in which a support point part 18*a* serves as a support point. FIGS. 4 and 6 illustrate that the second cover 18 has been detached from the body case 11; however, the second cover 18 can be opened and closed even without detaching the support point part 18*a*. In the second cover 18, a lock part 18*b* is locked with the body case 11, so that the second storage section 15 is held in a closed state.

In the ink ribbon cassette 10A, the first cover 17 is opened, so that the feeding core 20 and the mounting section 4A of the ink ribbon 1A are detachable from the first storage section 14. Furthermore, in the ink ribbon cassette 10A, the second cover 18 is opened, so that the winding core 21 of the ink ribbon 1A is detachable from the second storage section 15.

In the ink ribbon cassette 10A, the mounting section 4A is stored in the first storage section 14 of the body case 11 in a predetermined direction. Furthermore, in the ink ribbon cassette 10A, the shaft support part 12*c* of the first connection member 12 mounted at one end portion of the feeding core 20 is mounted in the first receiving part 14*a* of the first storage section 14. Moreover, the shaft support part 13*c* of the second connection member 13 mounted at the other end portion of the feeding core 20 is mounted in the second receiving part 14*b* of the first storage section 14. Then, the first cover 17 is closed.

In the ink ribbon cassette 10A, the shaft support part 12*c* of the first connection member 12 mounted at one end portion of the winding core 21 is mounted in the first receiving part 15*a* of the second storage section 15. Furthermore, the shaft support part 13*c* of the second connection member 13 mounted at the other end portion of winding core 21 is mounted in the second receiving part 15*b* of the second storage section 15. Then, the second cover 18 is closed.

In this way, in the ink ribbon cassette 10A, the mounting section 4A mounted with the RFID tag 3 is stored in the first storage section 14 in a predetermined direction, so that the RFID tag 3 is mounted at a predetermined position in the first storage section 14.

In the ink ribbon cassette 10A, the ink ribbon tape 2 between the feeding core 20 and the winding core 21 is exposed to a tape conveying part 16. Then, the winding core 21 is rotated, so that the ink ribbon tape 2 is fed from the feeding core 20 and is wound around the winding core 21, and thus the ink ribbon tape 2 exposed to the tape conveying part 16 is conveyed.

<Mounting Operation Example of Ink Ribbon of Ink Ribbon Cassette of Present Embodiment>

Next, with reference to each drawing, an operation for mounting the ink ribbon 1A in the ink ribbon cassette 10A will be described.

The ink ribbon 1A has a configuration in which the feeding core 20 wound with the ink ribbon tape 2 has been covered with the mounting section 4A and the core mounting part 12*a* of the first connection member 12 is inserted into one end portion of the feeding core 20 through one hole 40 of the mounting section 4A. In this way, the first connection member 12 is mounted at the one end portion of the feeding core 20.

In the ink ribbon 1A, the core mounting part 13*a* of the first connection member 13 is inserted into the other end portion of the feeding core 20 through the other hole 40 of the mounting section 4A. In this way, the second connection member 13 is mounted at the other end portion of the feeding core 20.

In the ink ribbon 1A, the core mounting part 12*a* is inserted into one end portion of the winding core 21, so that the first connection member 12 is mounted, and the core mounting part 13*a* is inserted into the other end portion of the winding core 21, so that the second connection member 13 is mounted.

In the ink ribbon 1A having the configuration in which the feeding core 20 wound with the ink ribbon tape 2 has been covered with the mounting section 4A, the feeding core 20 mounted with the first connection member 12 and the second connection member 13 and the mounting section 4A are stored in the first storage section 14 of the body case 11 in a predetermined direction.

In the ink ribbon 1A, the mounting section 4A is stored in the first storage section 14 of the body case 11 in a predetermined direction, so that the concave part 42*a* of the mounting section 4A is fitted around the positioning convex part 19 of the first storage section 14. In this way, as illustrated in FIG. 6, the mounting section 4A is placed at a predetermined position of the first storage section 14.

In the ink ribbon 1A, the shaft support part 12*c* of the first connection member 12 mounted at the one end portion of the feeding core 20 is mounted in the first receiving part 14*a* of the first storage section 14. Moreover, the shaft support part 13*c* of the second connection member 13 mounted at the other end portion of the feeding core 20 is mounted in the second receiving part 14*b* of the first storage section 14. Then, as illustrated in FIG. 5, the first cover 17 is closed.

Furthermore, in the ink ribbon 1A, the winding core 21 is stored in the second storage section 15 of the body case 11 in a predetermined direction and the shaft support part 12*c* of the first connection member 12 mounted at the one end portion of the winding core 21 is mounted in the first receiving part 15*a* of the second storage section 15. Moreover, the shaft support part 13*c* of the second connection member 13 mounted at the other end portion of the winding core 21 is mounted in the second receiving part 15*b* of the second storage section 15. Then, the second cover 18 is closed.

<Operation•Effect Example of Ink Ribbon Cassette of Present Embodiment>

In the ink ribbon cassette 10A of the present embodiment, the ink ribbon 1A having the RFID tag 3 is allowed to be detachable from the body case 11, so that the body case 11, the first connection member 12, and the second connection member 13 can be repetitively used and thus low-cost operation is possible.

Furthermore, the ink ribbon cassette 10A of the present embodiment includes the positioning convex part 19 in the first storage section 14, so that the storage of the mounting section 4A to the first storage section 14 in directions, other than a predetermined direction, is not possible by cooperation with the concave part 42*a* of the mounting section 4A.

That is, in the ink ribbon cassette 10A, when the direction of the mounting section 4A is not correct in an operation in which the feeding core 20 and the mounting section 4A of the ink ribbon 1A are mounted in the first storage section 14 of the body case 11, the mounting section 4A abuts on the positioning convex part 19 of the first storage section 14, and the mounting section 4A is not placed at a predetermined position. In this way, it is not possible to close the first cover 17.

In contrast, in the ink ribbon cassette 10A, the mounting section 4A is stored in the first storage section 14 of the body case 11 in a predetermined direction, so that the mounting section 4A is mounted in the body case 11 by employing the RFID tag 3 as a predetermined position.

In this way, in the ink ribbon cassette 10A of the present embodiment, the RFID tag 3 can be mounted at a predetermined position in the first storage section 14 in the operation in which the feeding core 20 and the mounting section 4A of the ink ribbon 1A are mounted in the first storage section 14 of the body case 11.

In the ink ribbon cassette 10A of the present embodiment, the shapes of the first storage section 14 and the second storage section 15 are allowed to be different from each other, so that the storage of the mounting section 4A to the second storage section 15 is not possible. In this way, in the ink ribbon cassette 10A of the present embodiment, it is possible to prevent the mounting section 4A mounted with the RFID tag 3 from being erroneously mounted in the second storage section 15. In addition, even when a convex-concave relation between the positioning convex part 19 and the concave part 42*a* has been switched, it is possible to prevent erroneous mounting.

<Configuration Example of Printer of Present Embodiment>

Figure 7:
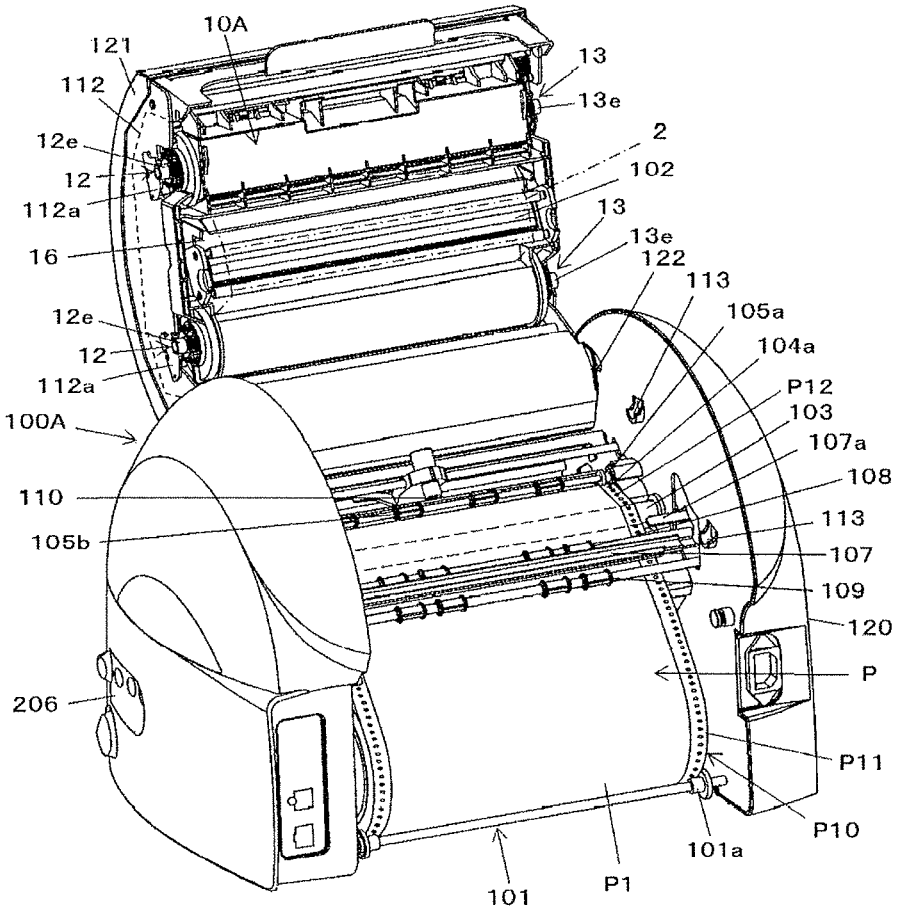
FIG. 7 is a configuration diagram illustrating an example of a printer according to the embodiment of the invention.
Figure 8:
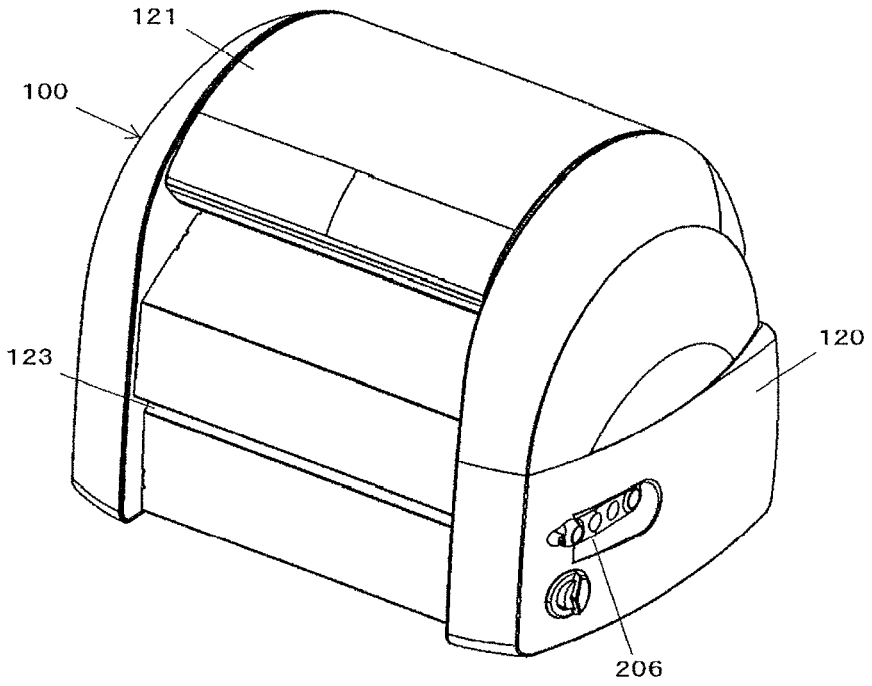
FIG. 8 is a configuration diagram illustrating an example of the printer according to the embodiment of the invention.
Figure 9:
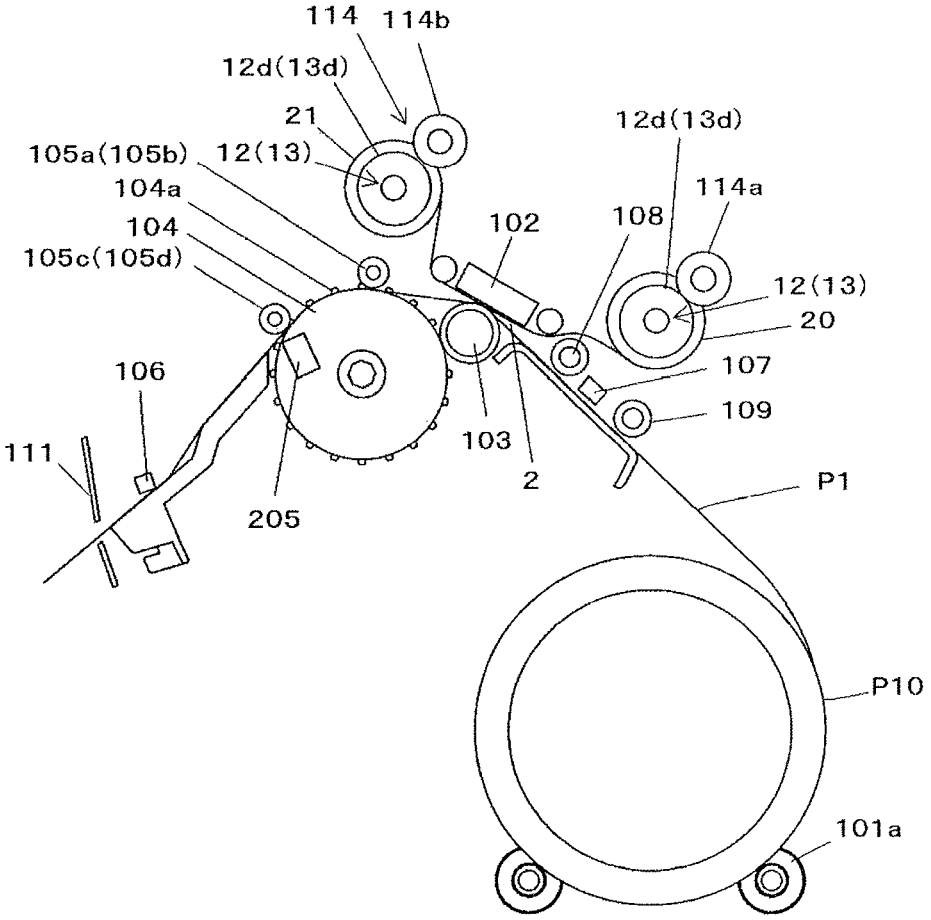
FIG. 9 is a configuration diagram illustrating an example of the printer according to the embodiment of the invention.
Figure 10:
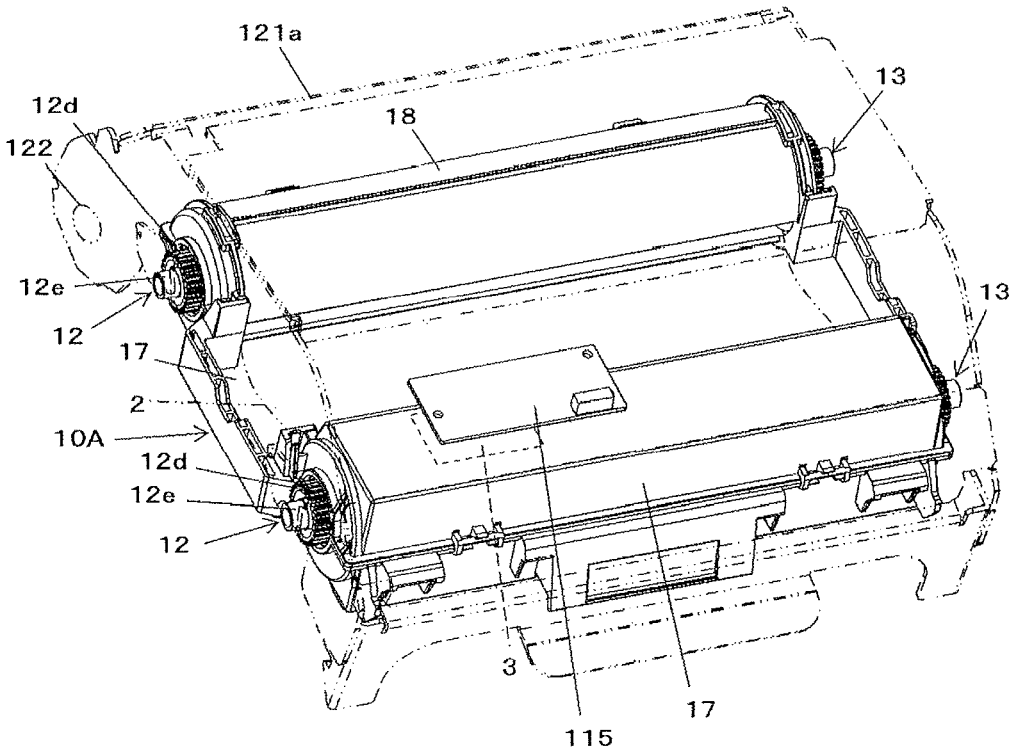
FIG. 10 is a configuration diagram illustrating an example of the printer according to the embodiment of the invention.

FIGS. 7 to 10 are configuration diagrams illustrating an example of a printer of the present embodiment. FIG. 7 is a perspective view when the cover in an open state is viewed from a rear surface in the printer of the present embodiment, and FIG. 8 is a perspective view when the cover in a closed state is viewed from a front surface in the printer of the present embodiment. FIG. 9 is a side view schematically illustrating a conveyance path of the printer of the present embodiment, and FIG. 10 is a perspective view illustrating the outline of antenna arrangement in the printer of the present embodiment.

A printer 100A of the present embodiment includes a mechanism that conveys a long sheet P1 stuck to a release paper P11 together with the release paper P11, performs printing on the sheet P1, and performs cutting (called the whole cutting) over the whole width of a paper P in the state in which the sheet P1 has been stuck to the release paper P11, and clipping or cutting of the sheet P1 in a predetermined shape.

The paper P is provided as a rolled paper P10 wound in the form of external winding in which a printing surface is directed outward. In the paper P, a plurality of through holes P12 called sprocket holes are formed at both ends in a width direction of the release paper P11 in a longitudinal direction at a constant interval. The sheet P1, the paper P in which the sheet P1 has been stuck to the release paper P11, and the rolled paper P10 wound with the paper P are an example of a print medium.

The printer 100A includes a loading section 101 in which the rolled paper P10 is loaded. The printer 100A includes a print head 102 that performs printing on the paper P drawn out from the rolled paper P10 loaded in the loading section 101, and a platen roller 103 that conveys the paper P to the print head 102 by pressing the paper P.

Moreover, the printer 100A includes sprocket rollers 104 that convey the paper P drawn out from the rolled paper P10 loaded in the loading section 101, pressing rollers 105*a* and 105*c* that press the paper P to the sprocket roller 104, a driven pressing roller 105*b* that presses the paper P inside the pressing roller 105*a* in the width direction of the paper P, and a driven pressing roller 105*d* that presses the paper P inside the pressing roller 105*c* in the width direction of the paper P.

Furthermore, the printer 100A includes a first cleaning member 106 and a second cleaning member 107 that clean the paper P, a first guide roller 108 and a second guide roller 109 that guide the paper P, a first cutting blade part 110 that performs clipping and cutting of the sheet P1, and a second cutting blade part 111 that performs cutting (called the whole cutting) over the whole cutting of the paper P.

Moreover, the printer 100A includes a cassette mounting section 112 in which the ink ribbon cassette 10A illustrated in FIG. 5 and the like is mounted, cassette support parts 113 that support the ink ribbon cassette 10A mounted in the cassette mounting section 112, and an ink ribbon conveying section 114 that conveys the ink ribbon tape 2 of the ink ribbon cassette 10A. Furthermore, the printer 100A includes an antenna 115 that communicates with the RFID tag 3 of the ink ribbon cassette 10A.

The printer 100A includes the loading section 101, the platen roller 103, the sprocket roller 104, the pressing rollers 105*a* and 105*c*, the driven pressing rollers 105*b* and 105*d*, the first cleaning member 106, the second cleaning member 107, the first guide roller 108, the second guide roller 109, the first cutting blade part 110, the second cutting blade part 111, and the cassette support parts 113 in a printer body 120.

Furthermore, the printer 100A includes the print head 102, the cassette mounting section 112, the ink ribbon conveying section 114, and the antenna 115 in a cover frame 121*a* which is a frame member of a cover 121. The cover 121 is mounted at the printer body 120 to be openable and closable by employing a shaft part 122 as a support point. In the printer 100A, a discharge port 123 of the paper P is provided at a front side of the printer body 120.

As illustrated in FIG. 7, in the printer 100A, when the cover 121 is opened, the ink ribbon cassette 10A mounted in the cassette mounting section 112 withdraws upward, so that the conveyance path of the paper P is exposed. In this way, the rolled paper P10 is loaded in the loading section 101 and the paper P is allowed to pass through the sprocket roller 104 and the pressing rollers 105*a* and 105*c*, thereby enabling the paper P to be conveyed. Furthermore, the exchange of the rolled paper P10 is possible.

Moreover, the ink ribbon cassette 10A is detachable from the cassette mounting section 112 of the cover 121. When the ink ribbon cassette 10A is mounted in the cassette mounting section 112, the RFID tag 3 is arranged to face the antenna 115, so that communication is possible.

As illustrated in FIG. 8, in the printer 100A, when the cover 121 is closed, the ink ribbon cassette 10A mounted in the cassette mounting section 112 is supported by the cassette support parts 113 of the printer body 120. Furthermore, as illustrated in FIG. 9, the print head 102 and the platen roller 103 face to each other while interposing the ink ribbon tape 2 and the paper P therebetween.

The loading section 101 is configured to have a space capable of storing the rolled paper P10 having a predetermined diameter, and is provided with sheet rollers 101*a* that support an outer periphery of the rolled paper P10.

The print head 102 is an example of a print unit and is configured with a thermal head in the present example. In the print head 102, a line-shaped element (not illustrated) is arranged to face the platen roller 103 in a direction along the axial direction of the platen roller 103. As an example, the print head 102 is configured such that its longitudinal length is larger than the width of the sheet P1 in the present embodiment.

The print head 102 is urged toward the platen roller 103 by a spring (not illustrated), so that the paper P is pressed by the platen roller 103.

The platen roller 103 is an example of a conveying unit (a conveying roller), and is configured with one roller that is rotationally driven in a forward and reverse direction by a motor (not illustrated) in the present example. The platen roller 103 is configured such that its axial length is larger than the width of the paper P, and its circumferential surface is brought into contact with an entire width direction of the paper P, so that the paper P is pressed to the print head 102.

The sprocket roller 104 is an example of a conveying unit (a conveying roller), and is provided at a downstream side of the platen roller 103 with respect to the conveyance direction of the paper P conveyed in the forward direction. The sprocket roller 104 is provided at both sides in the width direction of the paper P according to the arrangement of the through holes P12 provided at both sides in the width direction of the paper P, and pins 104*a* entering into the through holes P12 of the release paper P11 constituting a part of the paper P are provided in a circumferential direction according to an interval of the through holes P12.

The sprocket roller 104 is rotationally driven in the forward and reverse direction by a motor (not illustrated) in engagement with the platen roller 103. In the printer 100A, when the sprocket roller 104 and the platen roller 103 are rotationally driven in the forward direction, the paper P is conveyed in the forward direction, and the paper P pressed in the platen roller 103 is printed in the print head 102. Furthermore, the paper P is drawn out from the rolled paper P10. When the sprocket roller 104 and the platen roller 103 are rotationally driven in the reverse direction, the paper P is conveyed in the reverse direction.

The pressing roller 105*a* is provided to face the sprocket roller 104, and is rotationally driven in the forward and reverse direction by a motor (not illustrated) in engagement with the sprocket roller 104 and the platen roller 103.

The driven pressing roller 105*b* is provided between the pair of pressing rollers 105*a* coaxially with the pressing rollers 105*a*, and presses the paper P inside the pressing rollers 105*a* in the width direction of the paper P. The driven pressing roller 105*b* does not receive driving force that rotates the pressing rollers 105*a* and is rotated according to the conveyance of the paper P.

The pressing roller 105*c* is provided to face the sprocket roller 104 at a downstream side of the pressing rollers 105*a* with respect to the conveyance direction of the paper P conveyed in the forward direction. The pressing roller 105*c* is rotationally driven in the forward and reverse direction by a motor to be described later in engagement with the sprocket roller 104 and the platen roller 103.

The driven pressing roller 105*d* is provided between the pair of pressing rollers 105*c* coaxially with the pressing rollers 105*c*, and presses the paper P inside the pressing rollers 105*c* in the width direction of the paper P. The driven pressing roller 105*d* does not receive driving force that rotates the pressing rollers 105*c* and is rotated according to the conveyance of the paper P.

The first cleaning member 106 is provided at a downstream side of the sprocket roller 104 with respect to the conveyance direction of the paper P conveyed in the forward direction. The first cleaning member 106 is configured to be withdrawable from the conveyance path of the paper P.

The second cleaning member 107 is provided at an upstream side of the platen roller 103 with respect to the conveyance direction of the paper P conveyed in the forward direction. The second cleaning member 107 is configured to be withdrawable from the conveyance path of the paper P.

The first guide roller 108 is provided at a downstream side of the second cleaning member 107 and an upstream side of the platen roller 103 with respect to the conveyance direction of the paper P conveyed in the forward direction. The second guide roller 109 is provided at an upstream side of the second cleaning member 107 with respect to the conveyance direction of the paper P conveyed in the forward direction. The second guide roller 109 is configured to be withdrawable from the conveyance path of the paper P in engagement with the second cleaning member 107. In the present example, the second cleaning member 107 and the second guide roller 109 are configured to be displaceable in a direction separated from the conveyance path of the paper P through an operation of an operating lever 107*a*.

The first cutting blade part 110 is provided to face a part between the pair of right and left sprocket rollers 104 between a shaft member provided with the pressing roller 105*a* and the driven pressing roller 105*b* and a shaft member provided with the pressing roller 105*c* and the driven pressing roller 105*d* with respect to the conveyance direction of the paper P conveyed in the forward direction. The first cutting blade part 110 is configured to be driven by a motor (not illustrated) and to be movable in the width direction of the paper P, and performs an arbitrary shape of clipping and cutting of the sheet P1 by the conveyance of the paper P and the movement of the first cutting blade part 110.

The second cutting blade part 111 is provided at a downstream side of the first cleaning member 106 with respect to the conveyance direction of the paper P conveyed in the forward direction, and cuts the paper P, which has been subjected to predetermined processing such as printing, over the entire width thereof.

The cassette mounting section 112 is configured by providing a space, into which the ink ribbon cassette 10A illustrated in FIG. 5 and the like enters, to the cover 121, and includes a supporting mechanism (not illustrated) that supports the ink ribbon cassette 10A to be detachable. In the printer 100A, when the ink ribbon cassette 10A is mounted in the cassette mounting section 112, the ink ribbon tape 2 exposed to the tape conveying part 16 faces the print head 102.

The cassette mounting section 112 includes pressing parts 112*a* that press the shaft parts 12*e* of the first connection member 12 and the shaft parts 13*e* of the second connection member 13 mounted in the feeding core 20 of the ink ribbon cassette 10A illustrated in FIG. 4 and the like, and the shaft parts 12*e* of the first connection member 12 and the shaft parts 13*e* of the second connection member 13 mounted in the winding core 21.

The cassette support units 113 are provided at entrance positions of the shaft parts 12*e* of the first connection member 12 and the shaft parts 13*e* of the second connection member 13, which have been mounted in the feeding core 20 of the ink ribbon cassette 10A illustrated in FIG. 4 and the like, and the shaft parts 12*e* of the first connection member 12 and the shaft parts 13*e* of the second connection member 13, which have been mounted in the winding core 21.

In an operation of closing the cover 121 in which the ink ribbon cassette 10A has been mounted in the cassette mounting section 112, in the state in which the shaft parts 12*e* of the first connection member 12 and the shaft parts 13*e* of the second connection member 13 mounted in the feeding core 20 and the winding core 21 have been pressed by the pressing parts 112*a*, the printer 100A is supported by the corresponding cassette support parts 113.

In this way, the axial direction of the feeding core 20 and the winding core 21 wound with the ink ribbon tape 2 is matched with a direction approximately perpendicular to the conveyance direction of the paper P conveyed by the platen roller 103 and the sprocket rollers 104, so that the paper P and the ink ribbon tape 2 are conveyed approximately in parallel to each other.

The ink ribbon conveying section 114 includes a gear 114*a*, which is engaged with the gears 12*d* of the first connection member 12 and the gears 13*d* of the second connection member 13 mounted in the feeding core 20 of the ink ribbon cassette 10A illustrated in FIG. 4 and the like, and a braking member (not illustrated) which is connected to the gear 114*a* via a shaft (not illustrated).

Furthermore, the ink ribbon conveying section 114 includes a gear 114*b*, which is engaged with the gears 12*d* of the first connection member 12 and the gears 13*d* of the second connection member 13 mounted in the winding core 21 of the ink ribbon cassette 10A, and a motor (not illustrated in FIG. 9) that drives the gear 114*b*.

In the printer 100A, when the ink ribbon cassette 10A is mounted in the cassette mounting section 112 of the cover 121, the gears 12*d* of the first connection member 12 and the gears 13*d* of the second connection member 13 mounted in the feeding core 20 and the winding core 21 are engaged with the corresponding gear 114*a* and gear 114*b*, respectively.

In the operation of closing the cover 121 in which the ink ribbon cassette 10A has been mounted in the cassette mounting section 112, the engagement of the gears 12*d* of the first connection member 12 and the gears 13*d* of the second connection member 13 and the corresponding gear 114*a* and gear 114*b* are held in the state in which the shaft parts 12*e* of the first connection member 12 and the shaft parts 13*e* of the second connection member 13 mounted in the feeding core 20 and the winding core 21 have been respectively supported by the corresponding cassette support parts 113.

The antenna 115 is an example of a wireless communication unit using electromagnetic waves, and faces the RFID tag 3 of the ink ribbon cassette 10A as illustrated in FIG. 10 and is provided at a position in which communication between the RFID tag 3 and the antenna 115 is possible when the ink ribbon cassette 10A is mounted in the cassette mounting section 112.

<Functional Configuration Example of Printer of Present Embodiment>

Figure 11:
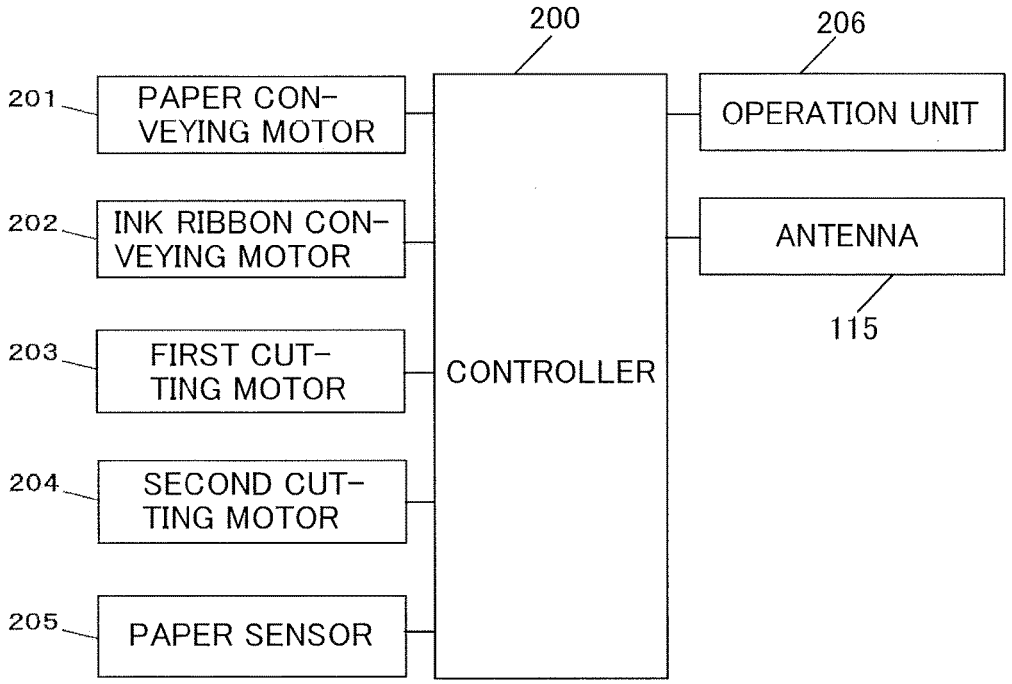
FIG. 11 is a configuration diagram illustrating an example of functions of the printer according to the embodiment of the invention.
Figure 12:
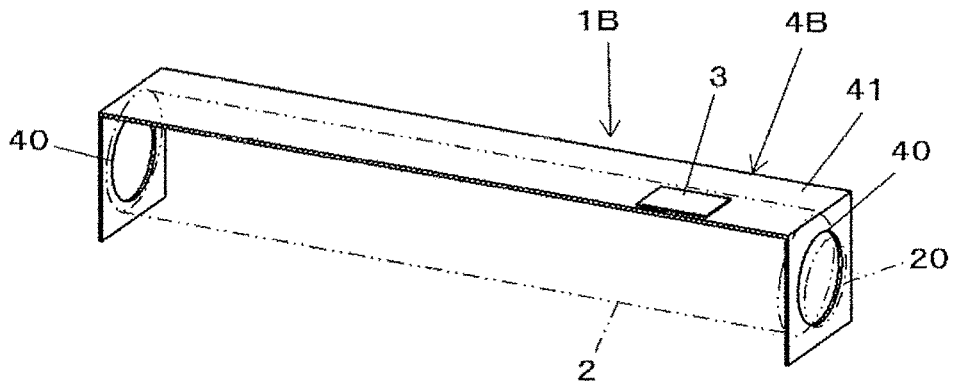
FIG. 12 is a configuration diagram illustrating an ink ribbon according to a modification example of the embodiment of the invention.

FIG. 11 is a block diagram illustrating an example of the functions of the printer of the present embodiment. The printer 100A of the present embodiment includes a controller 200 that controls printing of characters, images and the like based on print data, clipping and cutting of the sheet P1 based on outline data, cutting (called the whole cutting) over the whole width of the paper P based on cutting data, and the like.

Furthermore, the printer 100A includes a paper conveying motor 201 that drives the platen roller 103, the sprocket rollers 104, and the pressing rollers 105*a* and 105*c*, and an ink ribbon conveying motor 202 that drives the winding core 21. Furthermore, the printer 100A includes a first cutting motor 203 that drives the first cutting blade part 110, and a second cutting motor 204 that drives the second cutting blade part 111. Moreover, the printer 100A includes a paper sensor 205 that detects a front end of the paper P. Furthermore, the printer 100A includes an operation unit 206 that receives an operation such as conveyance of the paper P.

The controller 200 is an example of a control unit, and acquires print data from an external information processing device (not illustrated) such as a personal computer, drives the print head 102, the paper conveying motor 201 and the ink ribbon conveying motor 202, and performs printing on the sheet P1. Furthermore, the controller 200 drives the paper conveying motor 201 and the first cutting motor 203, thereby clipping the sheet P1 in a predetermined shape. Moreover, the controller 200 drives the paper conveying motor 201 and the second cutting motor 204, thereby cutting the paper P at a designated position.

<Operation Example of Printer of Present Embodiment>

Next, with reference to each drawing, an operation example of the printer 100A of the present embodiment will be described. First, the outline of a print operation will be described. The controller 200 moves the print head 102 in a direction near the platen roller 103, thereby allowing the paper P to be pressed to the ink ribbon tape 2 by the print head 102 and the platen roller 103.

In the state in which the paper P has been pressed to the ink ribbon tape 2, the controller 200 drives the paper conveying motor 201, thereby rotating the platen roller 103, the sprocket rollers 104, and the pressing rollers 105*a* and 105*c* in the normal rotation direction. Furthermore, the controller 200 drives the ink ribbon conveying motor 202, thereby rotating the winding core 21. Moreover, the controller 200 drives the print head 102.

In this way, the paper P is conveyed in the forward direction, the ink ribbon tape 2 is conveyed according to the conveyance of the paper P, and characters, images and the like corresponding to print data are printed on the sheet P1 in the print head 102.

Furthermore, the controller 200 moves the print head 102 in a direction separated from the platen roller 103, and drives the paper conveying motor 201 in the state in which the ink ribbon tape 2 has been separated from the paper P, thereby rotating the platen roller 103, the sprocket rollers 104, and the pressing rollers 105*a* and 105*c* in the reverse rotation direction. In this way, the paper P is conveyed in the reverse direction.

Next, an operation using the RFID tag 3 will be described. The controller 200 performs print control based on the possibility of communication between the RFID tag 3 of the ink ribbon cassette 10A and the antenna 115, and performs print control based on print information, consumption amount information and the like acquired from the RFID tag 3.

When the ink ribbon cassette 10A provided with a predetermined RFID tag 3 has been mounted in the printer 100A, the controller 200 communicates with the RFID tag 3 through the antenna 115, thereby acquiring print information, consumption amount information and the like, which are identification information, from the RFID tag 3.

The controller 200, for example, changes the amount of heat applied to the ink ribbon tape 2 from the print head 102 based on heat amount information specified by the print information acquired from the RFID tag 3 and corresponding to the ink ribbon tape 2. In this way, the ink ribbon tape 2 is heated by the print head 102 with an amount of heat suitable for the ink ribbon tape 2 and ink is transferred, so that print quality is improved.

Furthermore, based on a remaining amount of the ink ribbon tape 2 specified by the consumption amount information acquired from the RFID tag 3, when it is determined that the remaining amount of the ink ribbon tape 2 is not sufficient for example, the controller 200 performs no printing and performs notification for promoting the exchange of the ink ribbon cassette 10A. In this way, printing is prevented from being ended halfway due to the presence of the ink ribbon tape 2 before the printing is ended.

When an ink ribbon cassette with no RFID tag has been mounted, it is not possible to acquire print information, consumption amount information and the like. When it is not possible to acquire the print information, the consumption amount information and the like, the controller 200, for example, employs the amount of heat applied to the ink ribbon tape from the print head 102 as a prescribed value and performs printing. However, since it is not possible to heat the ink ribbon tape with an amount of heat suitable for the ink ribbon tape, transfer performance is reduced, resulting in the probability that print quality will be lowered. Furthermore, since it is not possible to recognize a remaining amount of the ink ribbon tape when it is not possible to acquire the consumption amount information, printing may be limited. Moreover, when presence/absence determination of the ink ribbon cassette 10A is performed according to whether it is possible to acquire information from the RFID tag 3 and it is determined that it is not possible to acquire information from the RFID tag 3 and the ink ribbon cassette 10A has not been mounted, the controller 200 may control a print operation not to be performed.

<Operation•Effect Example of Printer of Present Embodiment>

In a configuration in which an RFID tag has been provided to a rotating member such as a winding core of an ink ribbon tape, it is probable that the RFID tag does not face an antenna and communication is not possible according to an angle at which the rotating member stops.

In contrast, in the printer 100A of the present embodiment, when the ink ribbon cassette 10A is mounted in the cassette mounting section 112, the RFID tag 3 of the ink ribbon cassette 10A is positioned to face the antenna 115. Since the RFID tag 3 has been mounted in the mounting section 4A which is not rotated by a rotation operation of the feeding core 20 due to the conveyance of the ink ribbon tape 2, the position of the RFID tag 3 is not changed by the conveyance of the ink ribbon tape 2.

In this way, the positions of the RFID tag 3 and the antenna 115 are held in an always communicable state. Accordingly, it is possible to perform reading and recording of print information, consumption amount information and the like with respect to the RFID tag 3 at an arbitrary timing.

For example, the print information can be acquired from the RFID tag 3 at the time of the start of printing, so that the amount of heat applied to the ink ribbon tape 2 from the print head 102 is changed by the type of the ink ribbon tape 2 specified with the print information. In this way, it is possible to improve print quality from the beginning of printing.

Furthermore, at the time of the end of printing, the consumption amount of the ink ribbon tape 2 can be recorded as consumption amount information and can be updated, and consumption amount information up to previous printing of the corresponding ink ribbon tape can be acquired at the time of the start of next printing. In addition, even in the case of the mounting section 4A mounted with the RFID tag 3, when a direction is reversed, since the RFID tag 3 is mounted at a position which is closer to one end position than the other end position in the longitudinal direction of the tag mounting surface 41, the RFID tag 3 and the antenna 115 do not face each other. In this way, the RFID tag 3 and the antenna 115 are not able to communicate with each other, so that it is possible to perform printing limitation and the like.

In the ink ribbon 1A and the ink ribbon cassette 10A of the present embodiment, the mounting section 4A mounted with the RFID tag 3 is provided to a position facing the circumferential surface of the feeding core 20, so that it is not necessary to provide a projection configuration for mounting the RFID tag 3 in the axial direction of the feeding core 20. Thus, it is possible to reduce a device in size.

<Modification Example of Ink Ribbon of Present Embodiment>

FIGS. 12 to 18 are configuration diagrams illustrating modification examples of the ink ribbon of the present embodiment. In an ink ribbon 1B of a first modification example illustrated in FIG. 12, a mounting section 4B is formed with holes 40 having passed through one end surface and the other end surface in the axial direction of the feeding core 20. Furthermore, the tag mounting surface 41 is configured with one surface facing a width direction along the axial direction of the feeding core 20. In the mounting section 4B, the RFID tag 3 is adhered to the tag mounting surface 41 configured with a plane.

Figure 13:
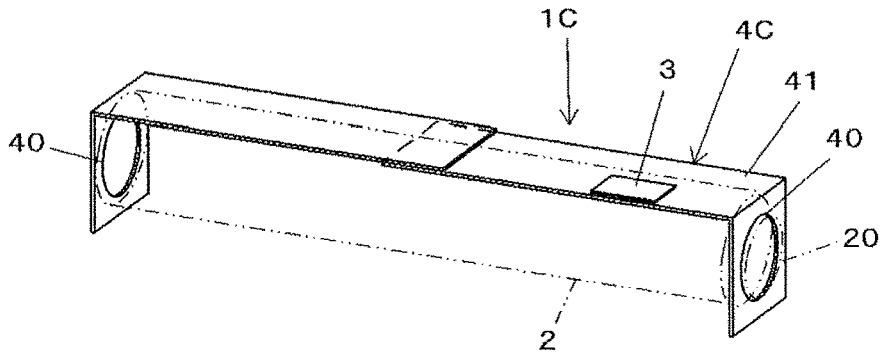
FIG. 13 is a configuration diagram illustrating an ink ribbon according to a modification example of the embodiment of the invention.

In an ink ribbon 1C of a second modification example illustrated in FIG. 13, a mounting section 4C is formed with holes 40 having passed through one end surface and the other end surface in the axial direction of the feeding core 20. Furthermore, the tag mounting surface 41 is configured with one surface facing a width direction along the axial direction of the feeding core 20. In the mounting section 4C, two parts divided in the tag mounting surface 41 in the present example are integrally configured with each other by adhesion by bonding and the like, and the RFID tag 3 is adhered to the tag mounting surface 41 configured with a plane.

Figure 14:
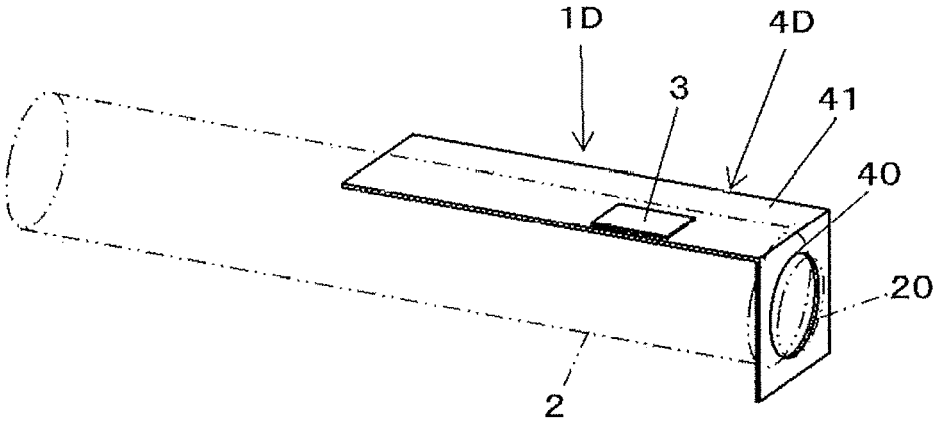
FIG. 14 is a configuration diagram illustrating an ink ribbon according to a modification example of the embodiment of the invention.

In an ink ribbon 1D of a third modification example illustrated in FIG. 14, a mounting section 4D is formed with a hole 40 having passed through one end surface in the axial direction of the feeding core 20. Furthermore, the tag mounting surface 41 is configured with one surface facing a width direction along the axial direction of the feeding core 20. In the mounting section 4D, the RFID tag 3 is adhered to the tag mounting surface 41 configured with a plane.

Figure 15A:
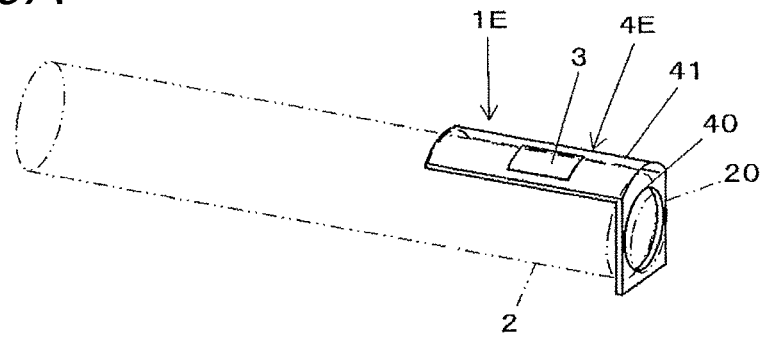
FIGS. 15A, 15B and 15C are configuration diagrams illustrating an ink ribbon according to a modification example of the embodiment of the invention.
Figure 15B:
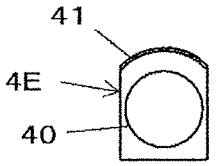
Figure 15C:
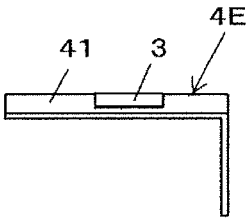

In an ink ribbon 1E of a fourth modification example illustrated in FIGS. 15A, 15B and 15C, a mounting section 4E is formed with a hole 40 having passed through one end surface in the axial direction of the feeding core 20 as illustrated in a perspective view of FIG. 15A. Furthermore, the tag mounting surface 41 is configured with one surface facing a width direction along the axial direction of the feeding core 20.

As illustrated in a side view of FIG. 15B and a front view of FIG. 15C, in the mounting section 4E, the tag mounting surface 41 is configured with a curved surface having a radius having a predetermined value or more and the RFID tag 3 is adhered to the tag mounting surface 41 configured with the curved surface. For a mounting place of the RFID tag 3, when the tag mounting surface 41 is configured with the curved surface, a recommended minimal radius has been decided, and when there is a curved surface having a radius exceeding the minimal radius, the RFID tag 3 may be configured to be adhered to the curved surface.

Figure 16A:
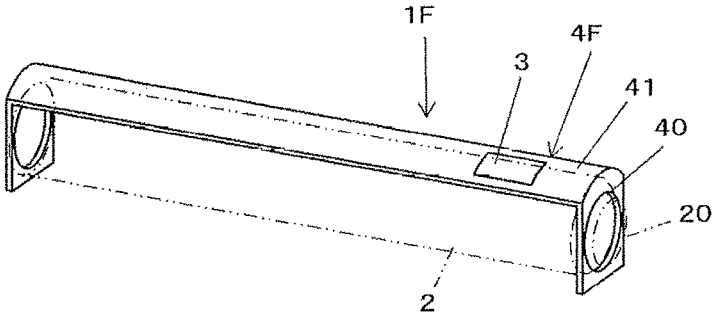
FIGS. 16A, 16B and 16C are configuration diagrams illustrating an ink ribbon according to a modification example of the embodiment of the invention.
Figure 16B:
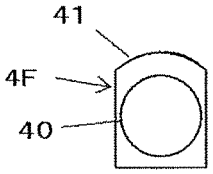
Figure 16C:
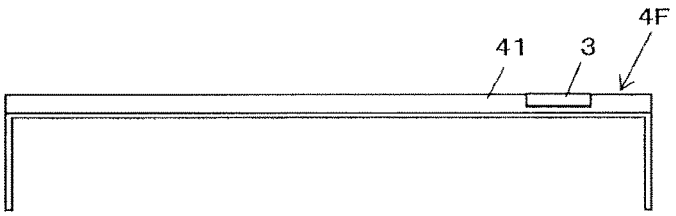

In all ink ribbon 1F of a fifth modification example illustrated in FIGS. 16A, 16B and 16C, a mounting section 4F is formed with holes 40 having passed through one end surface and the other end surface in the axial direction of the feeding core 20 as illustrated in a perspective view of FIG. 16A. Furthermore, the tag mounting surface 41 is configured with one surface facing a width direction along the axial direction of the feeding core 20.

As illustrated in a side view of FIG. 16B and a front view of FIG. 16C, in the mounting section 4F, the tag mounting surface 41 is configured with a curved surface having a radius having a predetermined value or more and the RFID tag 3 is adhered to the tag mounting surface 41 configured with the curved surface.

Figure 17:
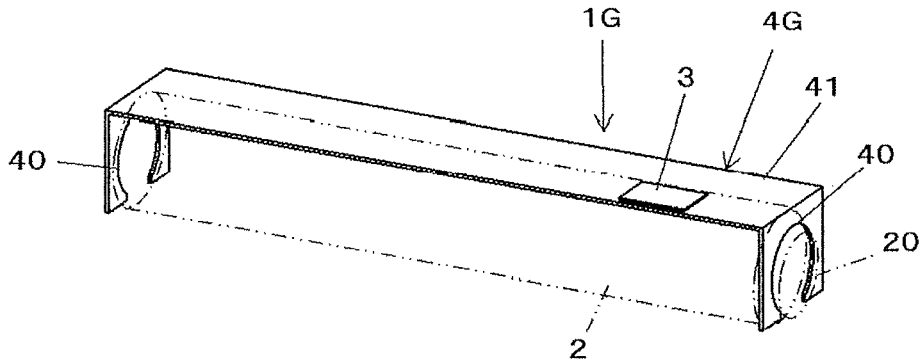
FIG. 17 is a configuration diagram illustrating an ink ribbon according to a modification example of the embodiment of the invention.

In an ink ribbon 1G of a sixth modification example illustrated in FIG. 17, a mounting section 4G is formed with holes 40 having passed through one end surface and the other end surface in the axial direction of the feeding core 20. Furthermore, the tag mounting surface 41 is configured with one surface facing a width direction along the axial direction of the feeding core 20. The holes 40 are configured by providing openings at sides other than connection parts with the tag mounting surface 41. In the mounting section 4G, the RFID tag 3 is adhered to the tag mounting surface 41 configured with a plane.

Figure 18:
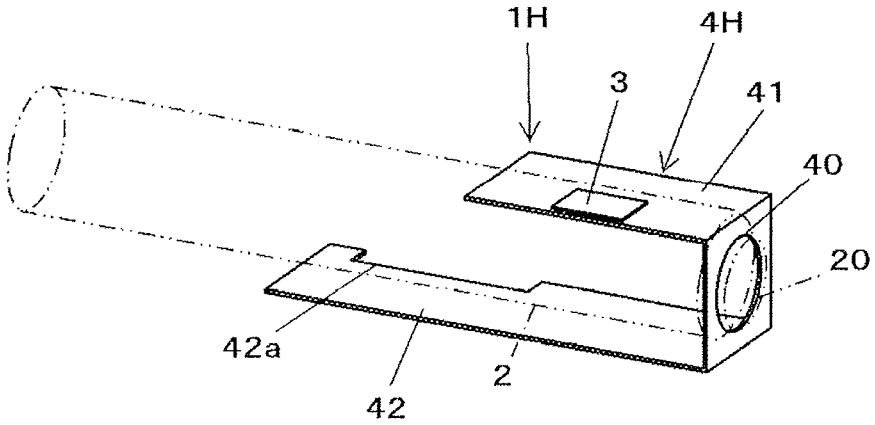
FIG. 18 is a configuration diagram illustrating an ink ribbon according to a modification example of the embodiment of the invention.

In an ink ribbon 1H of a seventh modification example illustrated in FIG. 18, a mounting section 4H is formed with a hole 40 having passed through one end surface in the axial direction of the feeding core 20. Furthermore, the tag mounting surface 41 is configured with one surface facing a width direction along the axial direction of the feeding core 20, and a positioning surface 42 is configured with the other surface.

The holes 40 are configured by providing openings at sides other than connection parts with the tag mounting surface 41. In the mounting section 4H, the RFID tag 3 is adhered to the tag mounting surface 41 configured with a plane. In the mounting section 4H, a concave portion 42*a* serving as a positioning portion is formed at one side portion of the positioning surface 42.

As described above, also in the ink ribbons 1B to 1H, the mounting sections 4B to 4H are provided to cover predetermined places other than the conveyance path of the ink ribbon tape 2 fed from the feeding core 20, and the RFID tag 3 is provided to be mounted in the mounting sections 4B to 4H. In the ink ribbons 1B to 1H, the mounting sections 4B to 4H mounted with the RFID tag 3 are provided together with the feeding core 20 wound with the ink ribbon tape 2. In this way, it is possible to provide the ink ribbons 1B to 1H having the RFID tag 3 at low cost.

In addition, in the ink ribbons 1A to 1H, the RFID tag 3 is configured to be adhered to the tag mounting surface 41 by an adhesive; however, an insertion configuration according to guide grooves and the like, or an interposition configuration between tow members, and the like may be employed. Furthermore, when the tag mounting surface 41 has been provided with resin, the RFID tag 3 may be formed integrally with the tag mounting surface 41. Moreover, the mounting sections 4A to 4H may not be always made of a transparent resin material, and it is sufficient if it is a material that does not interrupt communication between the RFID tag 3 and the antenna 115.

The present invention is applied to a printer using an ink ribbon tape which is transferred with heat and pressure.

What is claimed is:

1. An ink ribbon comprising:

a core that is configured to be wound with an ink ribbon tape; and a mounting section that is mounted with an identification information recording part in which identification information of the ink ribbon tape is recorded to be inputtable and outputtable, wherein the mounting section includes at least one hole section which supports at least one end portion of the core to be rotatable, the mounting section covers at least a part of the core via the ink ribbon tape wound around the core in a state where the core is rotatable, and the mounting section includes a positioning part which defines a position of the identification information recording part and which aligns a direction of the mounting section.

2. The ink ribbon according to claim 1, wherein the mounting section is provided with a mounting surface at a position facing a circumferential surface of the core, and the identification information recording part is mounted on the mounting surface.

3. The ink ribbon according to claim 2, wherein the identification information recording part is mounted at a position which is closer to one end portion of the mounting surface than the other end portion of the mounting surface along an axial direction of the core.

4. The ink ribbon according to claim 1, wherein the ink ribbon includes two hole sections, and one hole section supports one end portion of the core and the other hole section supports the other end portion of the core.

5. An ink ribbon cassette comprising:

an ink ribbon comprising:

a core that is configured to be wound with an ink ribbon tape; and a mounting section that is mounted with an identification information recording part in which identification information of the ink ribbon tape is recorded to be inputtable and outputtable, wherein the mounting section includes at least one hole section which supports at least one end portion of the core to be rotatable, and the mounting section covers at least a part of the core via the ink ribbon tape wound around the core in a state where the core is rotatable; and a body case in which the ink ribbon is stored to be detachable, wherein the body case includes:

a storage section which has a receiving part supporting a connection member to be rotatable and which stores the mounting section such that the mounting section covers at least a part of the core to be stored to be detachable, and the connection member is mounted in the core to be detachable.

6. The ink ribbon cassette according to claim 5, wherein the mounting section of the ink ribbon is provided with a positioning part which defines a mounting direction of the mounting section, and the storage section of the body case is provided with a part to be positioned, which is matched with the positioning part when the mounting section is stored in the storage section in a predetermined direction.

7. A printer comprising:

an ink ribbon comprising:

a core that is configured to be wound with an ink ribbon tape; and a mounting section that is mounted with an identification information recording part in which identification information of the ink ribbon tape is recorded to be inputtable and outputtable, wherein the mounting section includes at least one hole section which supports at least one end portion of the core to be rotatable, and the mounting section covers at least a part of the core via the ink ribbon tape wound around the core in a state where the core is rotatable;

an ink ribbon cassette in which the ink ribbon is stored to be detachable;

a cassette mounting unit from which the ink ribbon cassette is detached;

a print unit that performs printing on a print medium with the ink ribbon tape;

a conveying roller that conveys the print medium; and a communication unit that performs input and output of identification information with respect to the identification information recording part, wherein the ink ribbon cassette includes a body case that has a storage section which has a receiving part supporting a connection member and which stores the mounting section such that the mounting section covers at least a part of the core to be detachable, and the connection member is mounted in the core to be detachable.

8. An ink ribbon comprising:

a feeding core that is configured to be wound with an ink ribbon tape;

a winding core that is configured to wind the ink ribbon tape fed from the feeding core; and a mounting section that is mounted with an identification information recording part in which identification information of the ink ribbon tape is recorded to be inputtable and outputtable, wherein the mounting section includes at least one hole section which supports at least one end portion of the feeding core to be rotatable, the mounting section covers the feeding core only, without covering the winding core, and the mounting section covers only a part of the feeding core via the ink ribbon tape wound around the feeding core in a state where the core is rotatable.

* * * * *